US010207176B2

(12) United States Patent
Todokoro

(10) Patent No.: US 10,207,176 B2
(45) Date of Patent: Feb. 19, 2019

(54) HOME-USE CRANE GAME MACHINE

(71) Applicant: AGATSUMA CO., LTD., Tokyo (JP)

(72) Inventor: Shinji Todokoro, Tokyo (JP)

(73) Assignee: AGATSUMA CO., LTD., Tokyo (JP)

( * ) Notice: Subject to any disclaimer, the term of this patent is extended or adjusted under 35 U.S.C. 154(b) by 0 days.

(21) Appl. No.: 15/254,945

(22) Filed: Sep. 1, 2016

(65) Prior Publication Data

US 2017/0080329 A1 Mar. 23, 2017

(30) Foreign Application Priority Data

Sep. 17, 2015 (JP) ..... 2015-184004

(51) Int. Cl.
*A63F 9/30* (2006.01)
*G07F 17/32* (2006.01)

(52) U.S. Cl.
CPC ..... *A63F 9/30* (2013.01); *G07F 17/3297* (2013.01); *A63F 2250/142* (2013.01)

(58) Field of Classification Search
CPC ..... A63F 9/30; A63F 9/00
USPC ..... 273/447, 446, 440
See application file for complete search history.

(56) References Cited

U.S. PATENT DOCUMENTS 3,572,703 A * 3/1971 Greene ..... A63F 7/0058 212/327
4,685,673 A * 8/1987 Verstraeten ..... A63F 9/30 212/312
5,855,374 A 1/1999 Shoemaker
2007/0210523 A1* 9/2007 Verstraeten ..... A63F 9/30 273/447
2008/0088092 A1* 4/2008 Todokoro ..... A63F 9/30 273/447
2008/0090629 A1* 4/2008 Matsuda ..... A63F 9/30 463/7

FOREIGN PATENT DOCUMENTS

JP 4787124 B2 7/2011

OTHER PUBLICATIONS

Extended European Search Report for Application No. 16185252.0-1658 dated Jan. 3, 2017.

* cited by examiner

*Primary Examiner* — Melba Bumgarner
*Assistant Examiner* — Rayshun Peng
(74) *Attorney, Agent, or Firm* — The Marbury Law Group, PLLC

(57) ABSTRACT

There is provided a home-use crane game machine whose operation of a rotation transmission mechanism can be restored with ease that includes a plurality of motors 91, 92, 93 having a drive shaft to which a gear is fitted, rotation transmission mechanisms having a plurality of gears which are rotated by the plurality of motors 91, 92, 93, a catcher 65 for grabbing a prize 6 which is moved up and down by the rotation transmission mechanisms, a crane main body 54 having the motors 91, 92, 93 and the rotation transmission mechanisms internally, and rollers 68, 69, 70 connected to the rotation transmission mechanisms via input gear mechanisms.

1 Claim, 10 Drawing Sheets

HOME-USE CRANE GAME MACHINE

CROSS-REFERENCE TO RELATED APPLICATION

This application is based upon and claims the benefit of priority under 35 USC 119 of Japanese Patent Application No. 2015-184004 filed on Sep. 17, 2015, the entire disclosure of which, including the description, claims, drawings, and abstract, is incorporated herein by reference in its entirety.

BACKGROUND OF THE INVENTION

Field of the Invention

The present invention relates to a home-use crane game machine with which a player wins a prize using a catcher.

Description of the Related Art

There have been crane game apparatuses often seen in amusement arcades which a player controls a crane to catch a prize housed in the crane game apparatus. Many prizes are housed inside the crane game apparatus. A player inserts a coin and controls movement of the crane in lateral and longitudinal directions using control buttons. When the player stops the crane at an arbitrary position, the crane moves down to the bottom at the position with a catcher being opened and then moves up with the catcher being closed, then, the player can get the prize if the catcher catches the prize successfully.

For example, Japanese Patent No. 4787124 describes a home-use crane game machine which comprises: abase part which has a first button for outputting a X-axis motor movable signal, a second button for outputting a Y-axis motor movable signal, and a main substrate having a control device; a housing part disposed on the base part which is transparent and has a housing space for housing prizes in the inside; and a crane part which has a catcher having a bottom part formed in the teeth shape and a standing wall plate vertically protruding on the side of the bottom part, and a crane main body for controlling the movement of the catcher along X-axis direction, Y-axis direction and Z-axis direction.

However, a long period of use of the home-use crane game machine may cause problems, such as grease drying up applied to gears inside the crane main body, or gears/shafts jamming due to accumulated dust. When the crane main body and/or catcher stop working due to such problems, the player sometimes moves them forcibly by hand. This often causes breakage of the crane main body and/or catcher.

SUMMARY OF THE INVENTION

The present invention was made in view of the above described problems, an object of this is to provide a home-use crane game machine whose rotation transmission mechanism can be restored with ease.

A home-use crane game machine of the present invention comprises: a plurality of motors having a drive shaft to which a gear is fitted; a plurality of rotation transmission mechanisms each of which has a plurality of gears and is rotated by the plurality of motors respectively; a catcher for catching a prize which is moved up and down by one of the rotation transmission mechanisms; a crane main body having the motors and the rotation transmission mechanisms internally; and a plurality of rotating bodies connected to the respective rotation transmission mechanisms via an input gear mechanism.

The plurality of the motors, rotation transmission mechanisms, and rotating bodies are disposed separately to the crane main body in association with movement of the catcher in X-axis, Y-axis, and Z-axis directions.

The rotating bodies move the crane main body in the X-axis and Y-axis directions respectively by rotating respective shafts disposed to the crane main body. In addition, the rotating body moves the catcher in the Z-axis direction by rotating a chain winding member disposed to the crane main body.

The rotating body is disposed to a bottom part of the crane main body. Another rotating body is disposed to a side surface of a positive direction side of the X-axis of the crane main body. Apart of the other rotating body is exposed from an inside of the crane main body.

With the present invention, operation of any of the rotation transmission mechanisms can be restored with ease by rotating the respective rotating bodies by hand.

DETAILED DESCRIPTION OF THE PREFERRED EMBODIMENT

Figure 1:
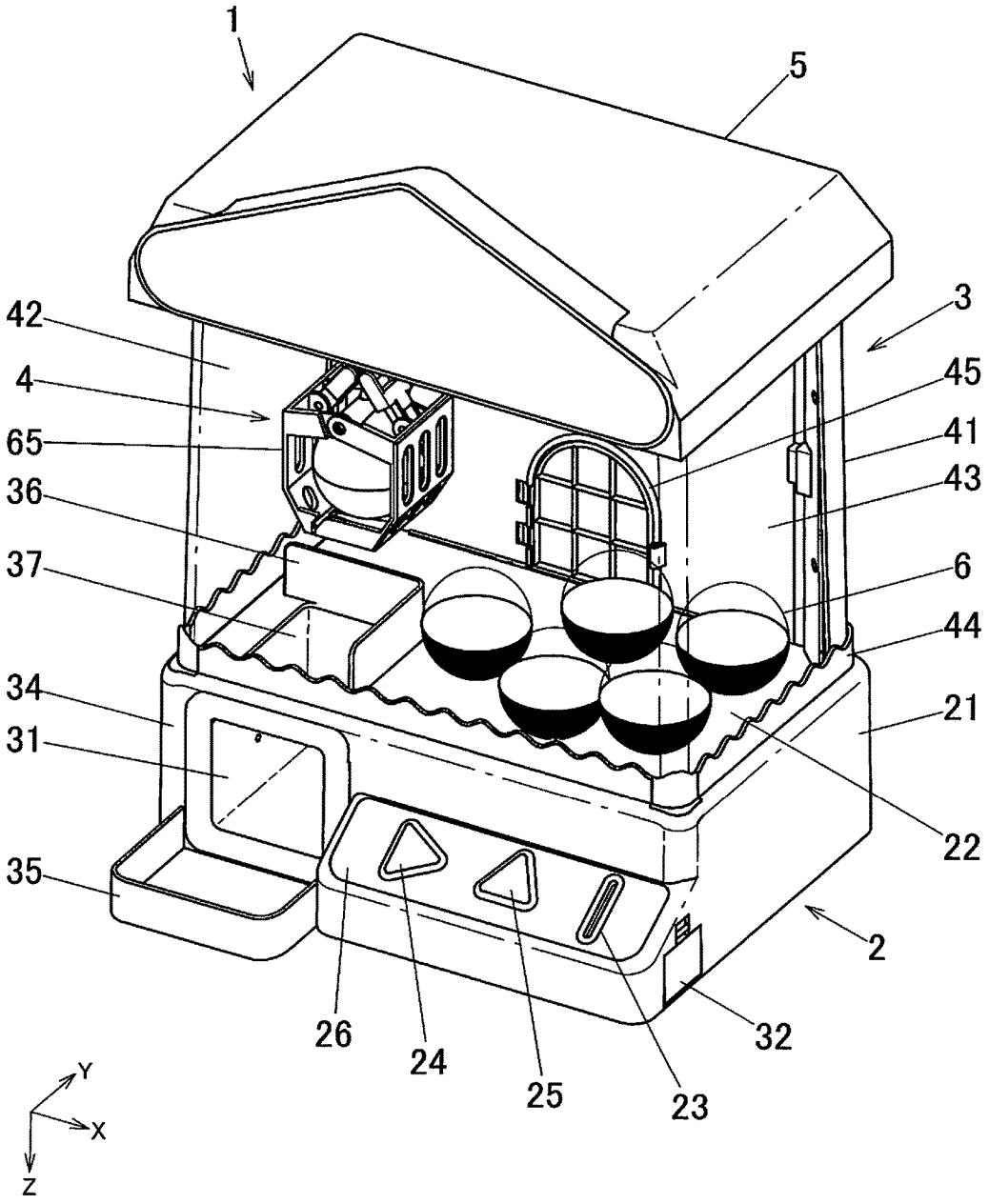
FIG. 1 is a perspective view of a crane game machine according to an embodiment of the present invention.

Hereinafter, an embodiment of the present invention will be described by use of the accompanying drawings. FIG. 1 is a perspective view of a crane game machine 1 according to an embodiment of the present invention. The crane game machine 1 is designed to be able to grab a prize with a catcher being controlled so as to be aligned above the prize, and to be played at home.

The crane game machine 1 comprises: a base part 2 which is a base of the crane game machine 1 and has a space in an inside thereof; a housing part 3 for housing a prize 6; a crane part 4 arranged above the housing part 3; and a roof 5 for covering the housing part 3 and a top part of the crane part 4. Hereinafter, in the crane game machine 1, left-right width direction is referred to as an X-axis, front-rear depth direction is referred to as a Y-axis, and top-bottom height direction is referred to as a Z-axis.

The base part 2 comprises: a base main body 21 which is substantially rectangular parallelepiped shape and has top and bottom surfaces; a prize placing board 22 which is disposed to the top surface of the base main body 21; a control part arranging plate 26 which is disposed to an upper front face side of the base main body 21 and has a coin slot 23, a first button 24, a second button 25; and a bottom board which is disposed to the bottom surface of the base main body 21.

A front face of the base main body 21 includes: a square-shaped prize discharge port 31 in a vicinity of a left end part; and a coin storage port 32 for taking a coin into and out from a space for storing the coin in a vicinity of a right end part. A peripheral edge of the prize discharge port 31 is covered with a peripheral edge cover 34, and a prize receiving tray 35 is protruded from the lower end of the prize discharge port 31.

The prize receiving tray 35 comprises a flat plate in a rectangular shape with round corners and a thick peripheral wall protruding upward vertically from the peripheral edge of the flat plate except for the edge fitted to the prize discharge port 31. The prize receiving tray 35 is formed flat and protruded from the base main body 21 so that young children may easily take the prize 6, and the peripheral wall prevents the prize 6 from popping out from the prize discharge port 31.

The coin storage port 32 is formed on a lower side surface proximity to a front face of the crane game machine 1 and an inside of the coin storage port 32 is the space for storing the coin. The coin storage port 32 is covered by a lid having a knob. The coin stored in the space can be taken out by opening the lid with the knob being pushed.

A main switch (not shown) of the crane game machine 1 is disposed to a rear face of the base main body 21. A bottom face of the base main body 21 is provided with a battery storage box for storing a battery to be used as a main power, and a sound output device for outputting various sounds.

The prize placing board 22 is an L-shaped plate forming a square-shaped opening part at a prescribed corner of a square plate, and the center thereof is inclined so as to be slightly lower than the periphery thereof. When the number of the prize 6 in the inside of the housing part 3 is reduced, remaining prizes 6 are automatically gathered toward the center of the prize placing board 22 by the inclination so as to facilitate grabbing the prize 6.

The opening part of the prize placing board 22 is, as shown in FIG. 1, a prize drop port 37 which is connected to the prize discharge port 31 formed in the vicinity of a front end of the base main body 21, and a transparent prize guide wall 36 is provided to a peripheral edge of the prize drop port 37 in such a manner as to project vertically. The prize guide wall 36 guides the prize 6 to the prize drop port 37 when the prize 6 held by the catcher 65 of the crane part 4 is fallen to the prize drop port 37.

The control part arranging plate 26 of the base part 2 is substantially a rectangular plate and is arranged so as to be slightly oblique towards the front face of the base main body 21. The coin slot 23 is formed on the right of the control part arranging plate 26, a coin feed sensor for detecting the insertion of the coin is arranged directly below the coin slot 23. The first button 24 for controlling the movement of a crane main body (described later) in X-axis direction (width direction) and the second button 25 for controlling the movement of the crane main body in Y-axis direction (depth direction) are arranged in order, and a main substrate is placed on a back side of the first button 24 and second button 25.

The coin feed sensor is designed such that a switch inside the coin feed sensor is pushed to be activated by an inserted coin. A sound is generated and the first but ton 24 can be operated when the coin is inserted when a main power switch is ON, and then the inserted coin falls to a coin storage port 32.

A path through which the prize 6 goes is formed between the prize drop port 37 and the prize discharge port 31, and the infrared sensor is disposed on the side surface of the path. The infrared sensor reacts when the prize 6 passes through the path between the prize drop port 37 and the prize discharge port 31, and outputs a prize 6 acquisition success signal to the main substrate.

The housing part 3 comprises, as shown in FIG. 1, two support columns 41, three transparent plates 42, a back plate 43, and the prize 6 housed inside the housing part 3. A picture of a character or the like is displayed on the back plate 43.

The support columns 41 are each vertically disposed and fixed to near respective rear corners of the base part 2. The transparent plates 42 surround front and both sides of the housing part 3. Lower outsides of the support columns 41 and transparent plates 42 are surrounded by a fixing part 44 which is formed vertically on the base part 2. A top part of the fixing part 44 is formed into a wave shape. The back plate 43 is fixed between the two support columns 41. A swing door 45 is installed to a lower center part of the back plate 43. One of the support columns 41 which fixes the back plate 43 has a latch for latching the back plate 43. The prize 6 can be put in the housing part 3 with opening the swing door 45.

Figure 2:
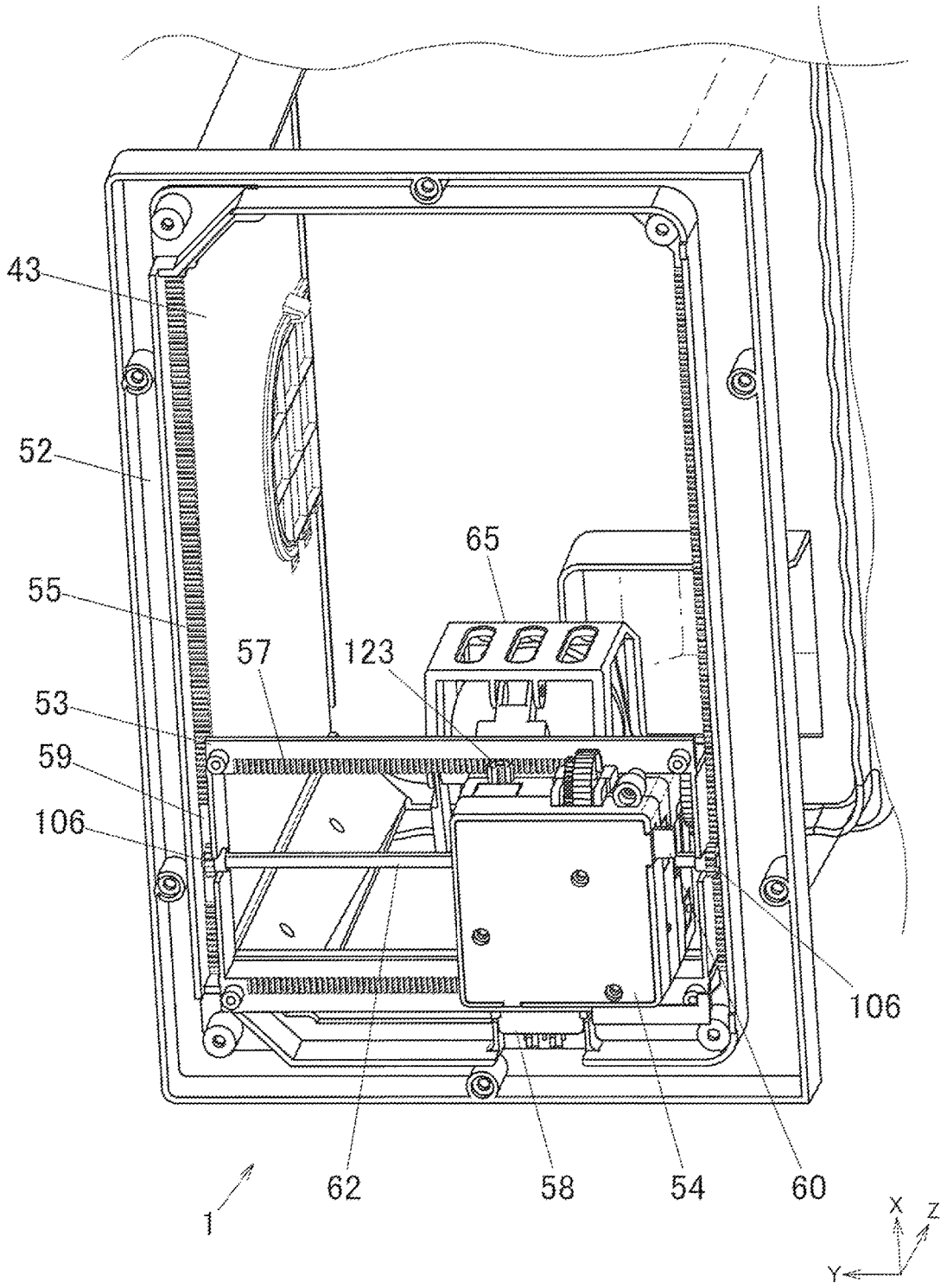
FIG. 2 is a top view of a housing part with a roof removed according to the embodiment of the present invention.

The crane part 4 comprises, as shown in FIG. 2, a movable part support frame 52 for covering top portions of the transparent plates 42 and support columns 41, a slide frame 53 for sliding on the movable part support frame 52, a crane main body 54 attached to the slide frame 53, and a movable part cover (not shown) for covering the crane main body 54.

The movable part support frame 52 is a rectangular frame for covering the top portions of the transparent plates 42 and support columns 41. X-axis sliding racks 55 are each formed to project inwards on front and back side surfaces of the movable part support frame 52 respectively, and the slide frame 53 having the crane main body 54 slides in the X-axis direction along the X-axis sliding racks 55. The movable part support frame 52 has an X-axis switch 58 which is disposed to a home position of the X-axis direction on the interior surface of the movable part support frame 52 parallel to the Y-axis direction. The movement in the X-axis direction of the slide frame 53 is stopped when the X-axis switch 58 is pushed by the slide frame 53 having the crane main body 54.

When the slide frame 53 moves to a limit position of the X-axis positive side, a clutch (not shown) of an X-axis rotation transmission mechanism (described later), which is built in the crane main body 54, is activated to stop the X-axis directional movement of the slide frame 53. Alternatively, the X-axis switch may be disposed to the limit position of the X-axis direction on the interior surface of the movable part support frame 52 parallel to the Y-axis direction.

The slide frame 53 is a rectangular frame, with the Y-axis direction being referred to as longitudinal direction, a length of the longitudinal direction is substantially the same as the length of the interior surface of the movable part support frame 52 in the Y-axis direction, top portions of both end faces of the slide frame 53 in the Y-axis direction are each formed outwardly extended, Y-axis sliding racks 57 are formed on top surfaces of the outwardly extended top portions respectively, bottom portions of both end faces of the slide frame 53 parallel to the X-axis direction are formed so as to project outwardly under the movable part support frame 52, and cutouts are formed at each center of the both end faces of the slide frame 53 in the X-axis direction from top to near bottom in which a X-axis movable axis 62 of the crane main body 54 (described later) is placed.

A plane surface 59 is formed, instead of a gear receiver, at apart of aback side of the X-axis direction home position on the X-axis sliding racks 55. The slide frame 53 and the X-axis/Y-axis may sometimes be misaligned due to toppling or vibration during transportation of the crane game machine 1.

However, the slide frame 53 can be returned to a normal position which is parallel to the X-axis and Y-axis since a back side gear 106 spins freely and a front side gear 106 only meshes with the gear receiver when the slide frame 53 passes over the plane surface 59 in returning to the X-axis direction home position. The plane surface 59 formed on the X-axis sliding racks 55 may be provided to other positions of the X-axis sliding racks 55, not limited to the back side of the X-axis direction home position.

Next, the crane main body 54 will be described with reference to FIG. 3. The crane main body 54 is a substantially rectangular parallelepiped box shape having an interior blocked to three sections. A bottom protrusion 84 is formed at a near bottom part of an outer surface which is parallel to the Y-axis direction of the crane main body 54 for housing a part of gears. An X-axis motor and Y-axis motor are disposed to the inside of the lower area of the crane main body 54 as power for movements of the X-axis and Y-axis. A part of a rear portion of a Y-axis motor 92 is exposed from a cutout 85 in a front face of the crane main body 54.

Referring back to FIG. 2, the X-axis movable shaft 62 having the gears 106 at its end portions for meshing with the X-axis sliding racks 55 of the movable part support frame 52 and a Y-axis movable shaft 63 having gears 123 at its end portions for meshing with the Y-axis sliding racks 57 of the slide frame 53 project from the side surfaces of the crane main body 54, and respective rotation transmission mechanisms for the X, Y, and Z-axes made up of various gears (described later) are built in the crane main body 54.

A roller 68 (rotating body) is provided to a lower right portion on the front face of the crane main body 54. Rotating the roller 68 forward or backward by hand moves the crane main body 54 in the positive direction or negative direction of the X-axis direction. A roller (rotating body) is provided to a rear end portion on a bottom face of the crane main body 54. Rotating the roller 69 forward or backward by hand moves the crane main body 54 in the positive direction or negative direction of the Y-axis direction.

Figure 8:
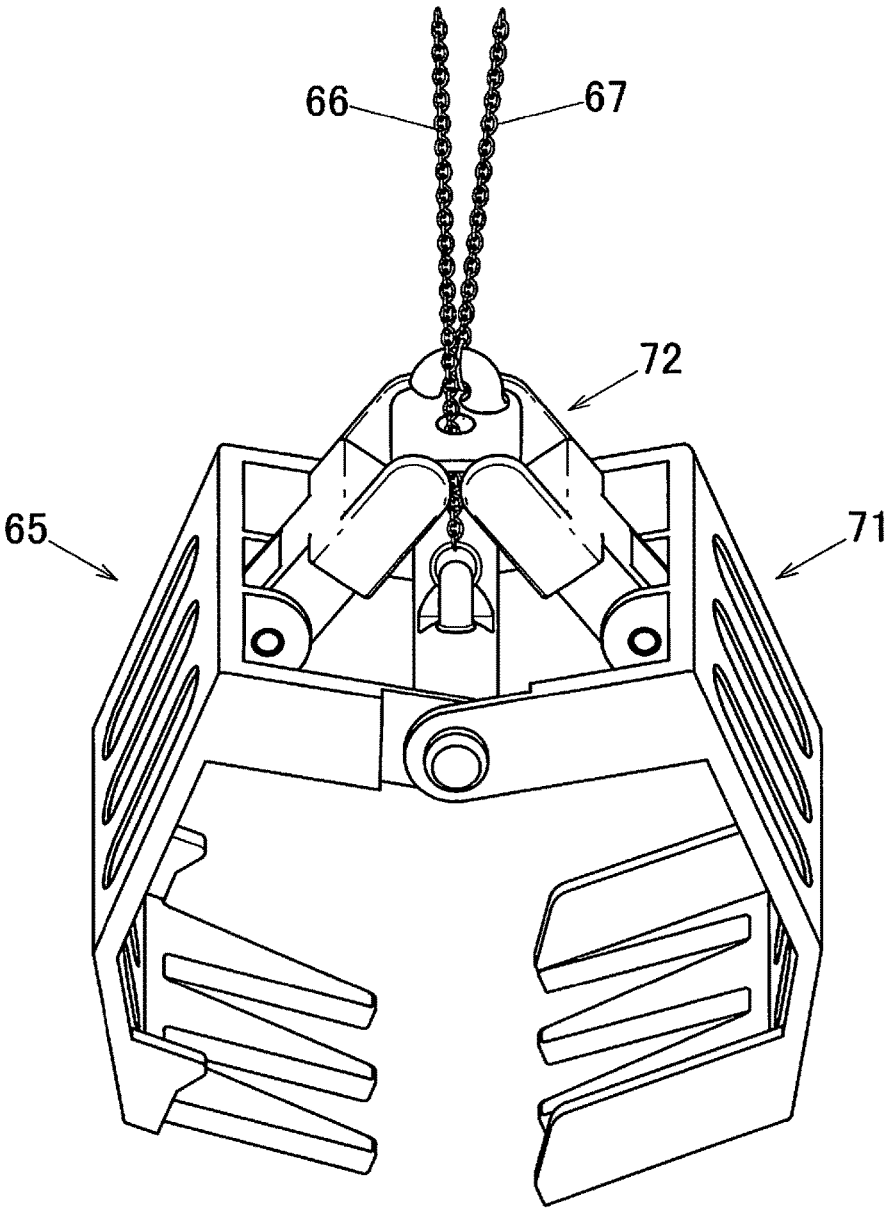
FIG. 8 is a perspective view of a catcher according to the embodiment of the present invention.

A mid-section of the crane main body 54 is provided with a Z-axis motor as power for moving up and down the catcher 65 and various gears (described later), and is connected with two chains for suspending the catcher 65. As shown in FIG. 8, one end of a first chain 66 is connected to a catcher main body 71, and one end of a second chain 67 is connected to an upper support part 72. The other ends of the first chain 66 and second chain 67 are fixed to a winding member (described later) provided to the inside of the crane main body 54 through holes 79, 80 formed in a vicinity of a center of a bottom surface of the crane main body 54.

The second chain 67 suspends the whole catcher 65 when the Z-axis motor rotates in the positive direction, and the first chain 66 suspends the whole catcher 65 when the Z-axis motor rotates in the negative direction.

Figure 3:
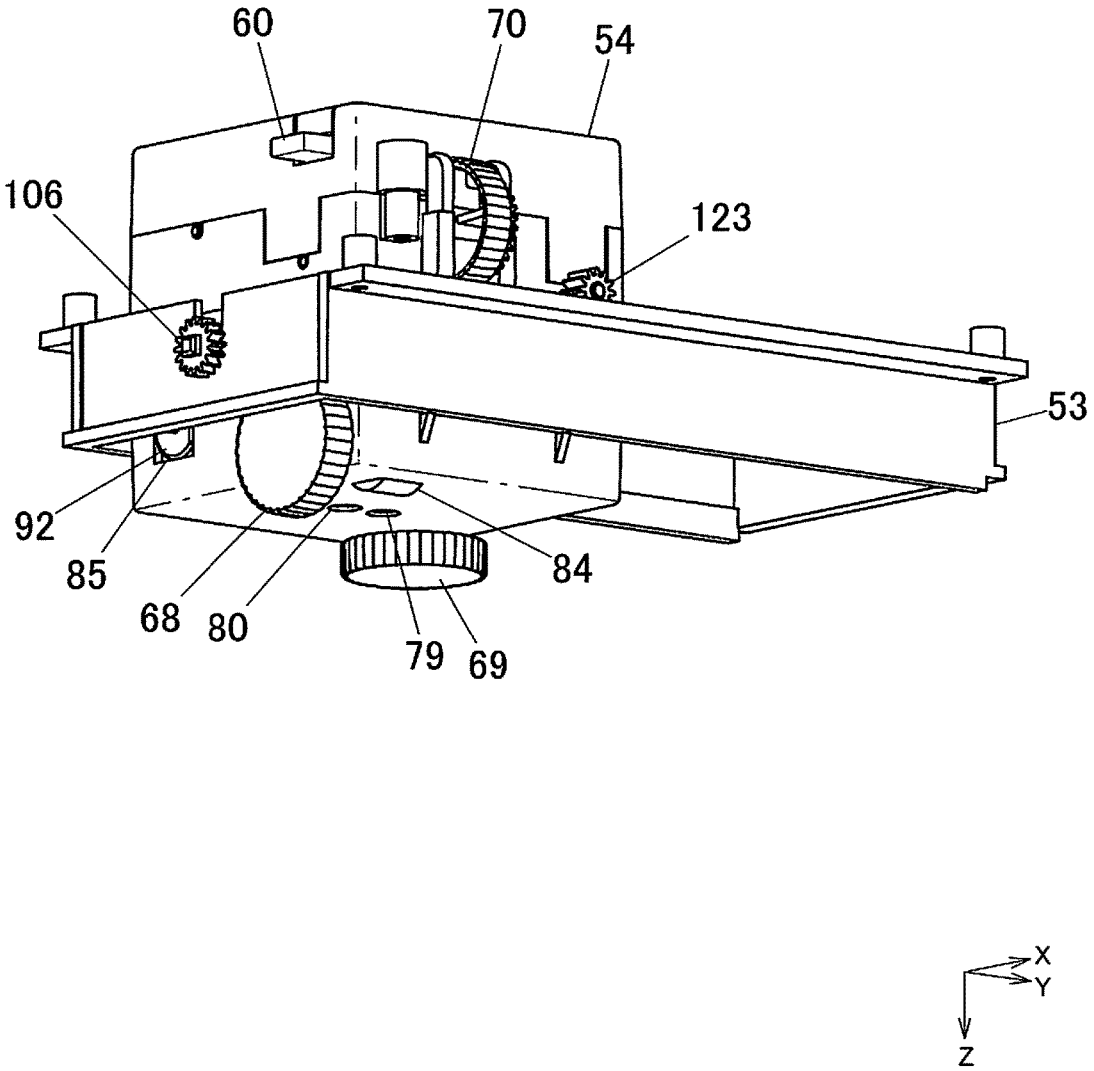
FIG. 3 is a perspective view of a crane main body according to the embodiment of the present invention.

A roller 70 (rotating body) is provided to a position above the slide frame 53 and in a vicinity of a center on a side surface of the crane main body 54, as shown in FIG. 3. A half of the roller 70 is arranged inside the crane main body 54, and a remaining half is exposed to the outside. Rotating the roller 70 forward or backward by hand moves the first chain 66 and second chain 67 in the positive direction or negative direction of the Z-axis direction.

Figure 4:
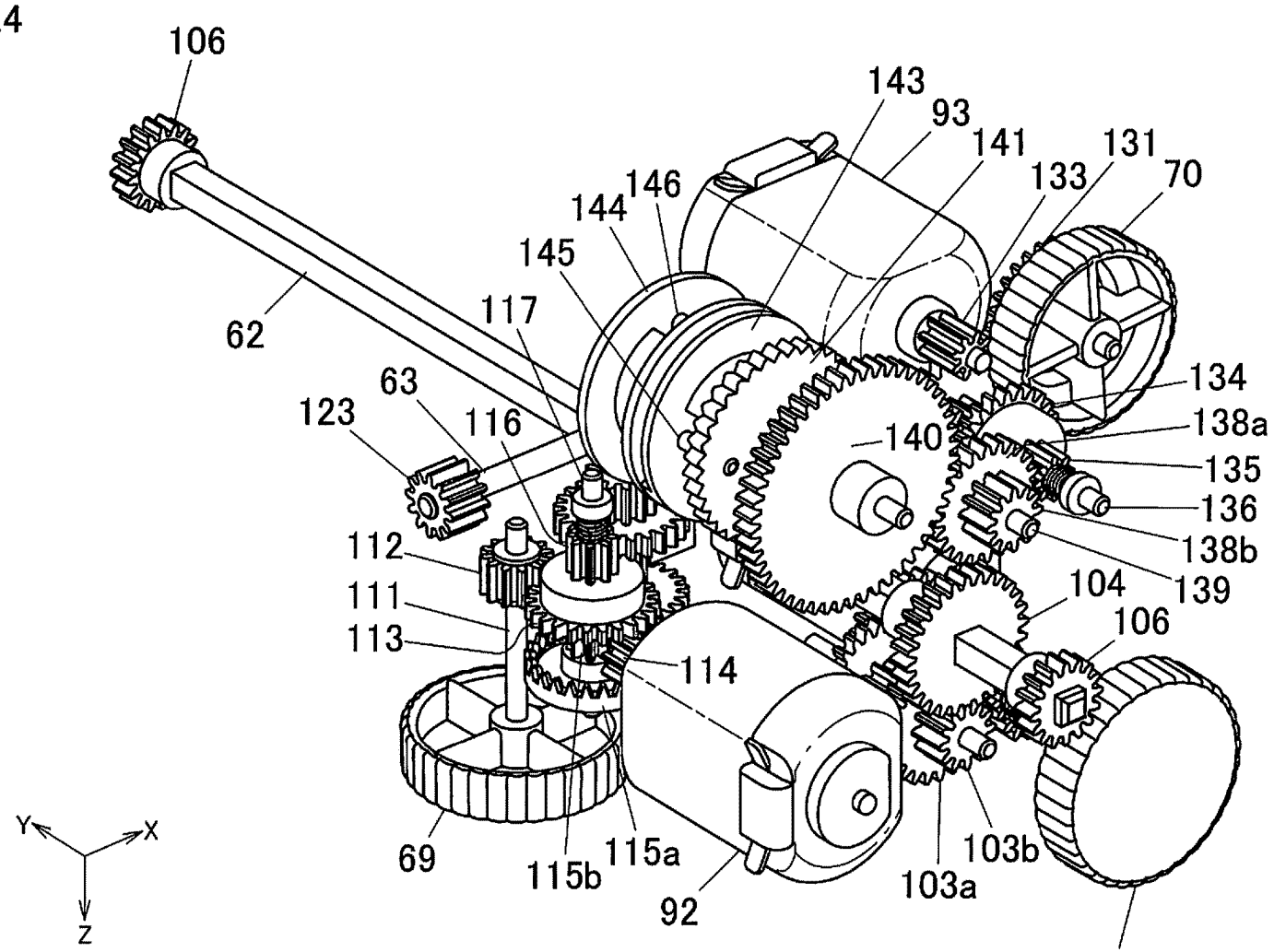
FIG. 4 is a perspective view of a front side of an interior of the crane main body according to the embodiment of the present invention.
Figure 5:
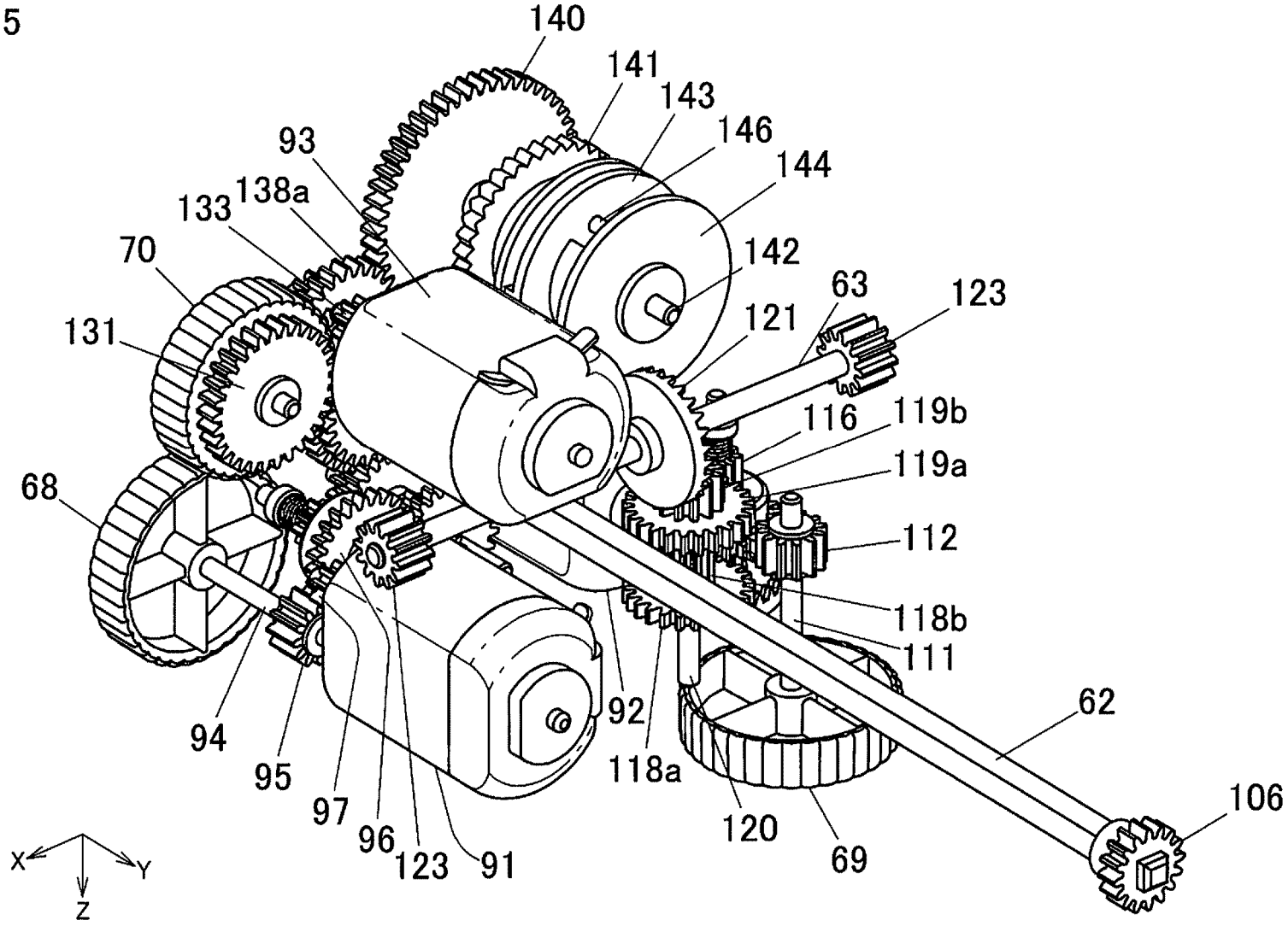
FIG. 5 is a perspective view of a rear side of the interior of the crane main body according to the embodiment of the present invention.
Figure 6:
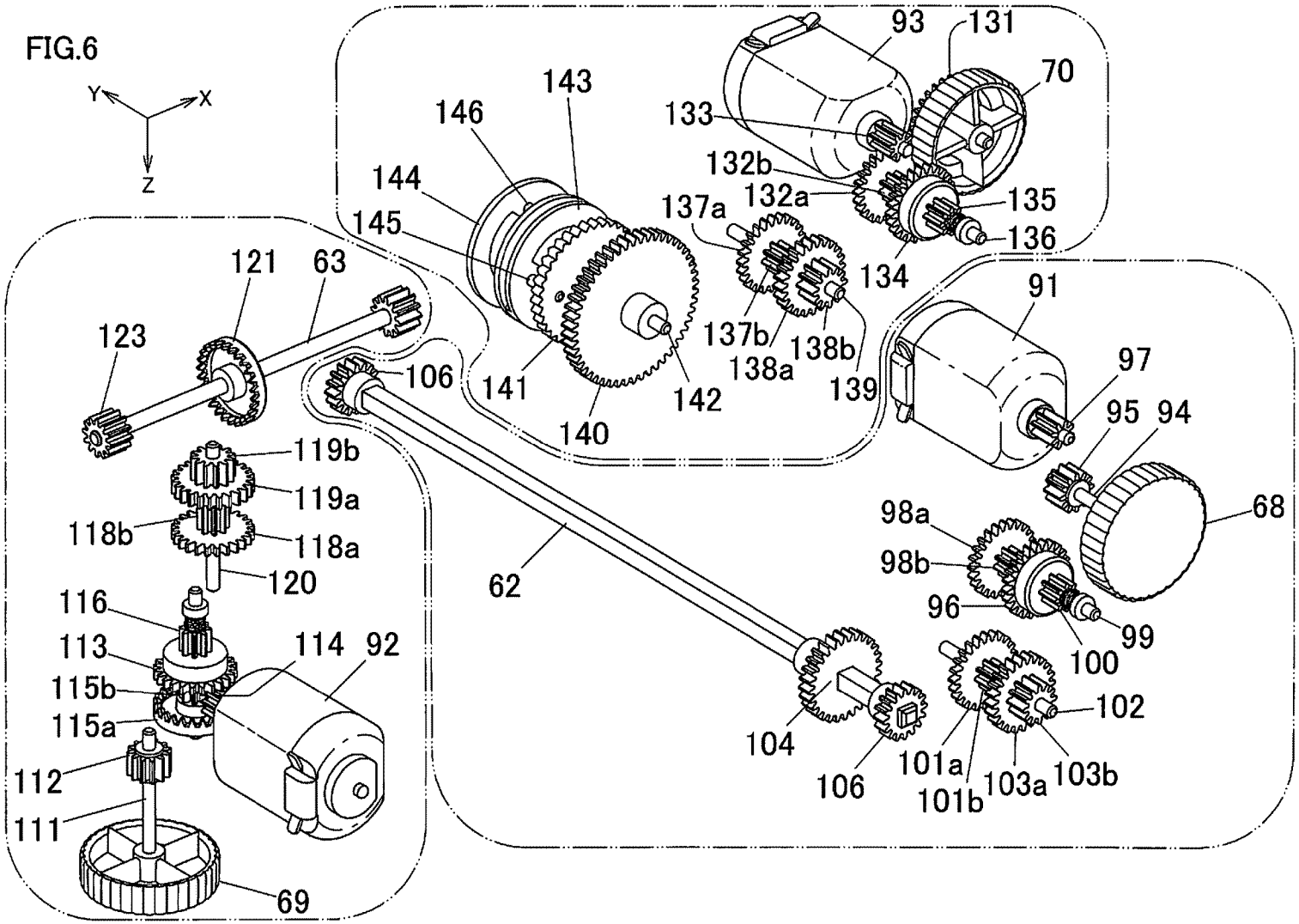
FIG. 6 is an exploded perspective view of the front side of the interior of the crane main body according to the embodiment of the present invention.
Figure 7:
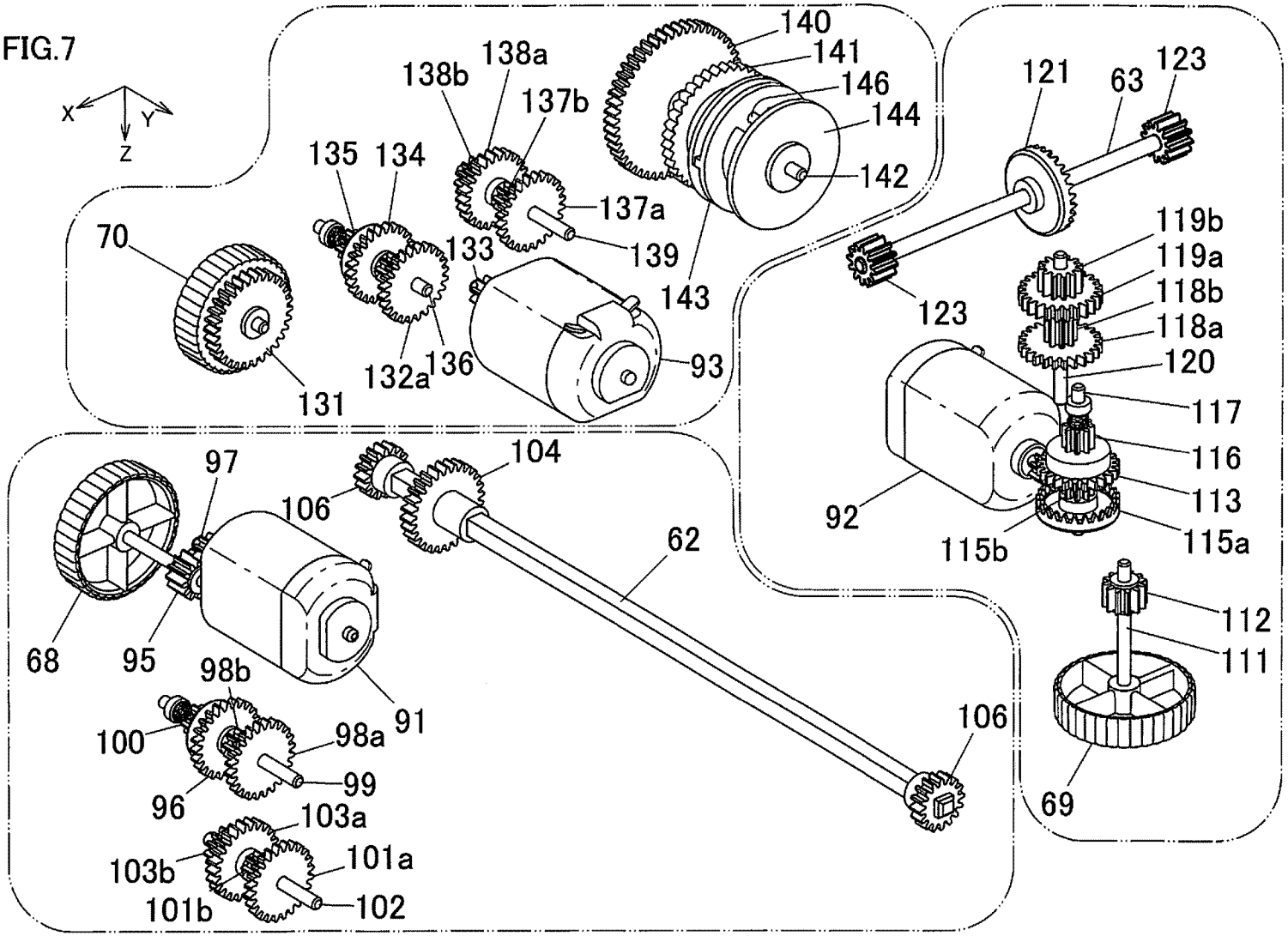
FIG. 7 is an exploded perspective view of the rear side of the interior of the crane main body according to the embodiment of the present invention.

Next, motors and gears mounted in the crane main body 54 will be described. FIG. 4 is a perspective view of a front side of an interior of the crane main body according to the embodiment of the present invention. FIG. 5 is a perspective view of a rear side of the interior of the crane main body according to the embodiment of the present invention. FIG. 6 is an exploded perspective view of the front side of the interior of the crane main body according to the embodiment of the present invention. FIG. 7 is an exploded perspective view of the rear side of the interior of the crane main body according to the embodiment of the present invention.

The interior of the crane main body 54 is blocked to the three sections, and includes an X-axis motor 91, the Y-axis motor 92, a Z-axis motor 93, a plurality of gears, and the rollers 68, 69, 70. A gear 97 which is fixed to a shaft of the X-axis motor 91 engages with a gear 98*a*, as shown in FIGS. 5, 7. A gear 98*b* having a smaller pitch circle diameter than the gear 98*a* is formed at a central gear 96 side from the gear 98*a*. The gear 96 and the gears 98*a*, 98*b* are fixed to a shaft 99.

The roller 68 for rotating gears relevant to the X-axis by hand is provided to a lower end portion on the front face of the crane main body 54. An end of a shaft 94 is fixed to a center of a back face of the roller 68, and a gear 95 is fixed to the other end of the shaft 94. The gear 95 meshes with the gear 96. An input gear mechanism is made up with the gear 95 and gear 96.

A gear 100 is fixed to an end of a gear 96 side of the shaft 99. A circular cylinder is fixed to a back face of the gear 100, and aback face of the circular cylinder contacts with a front face of the gear 96. The gear 98*b* meshes with a gear 101*a*. A gear 101*b* having a smaller pitch circle diameter than the gear 101*a* is formed at a front side of a center of the gear 101*a*. The gear 96 meshes with the gear 101*b*. Gears 103 are fixed to an end of a front side of a shaft 102 to which the gears 101 are fixed. The gear 100 meshes with a gear 103*a*. A gear 103*b* having a smaller pitch circle diameter than the gear 103*a* is formed at a front side of a center of the gear 103*a*. A gear 104 is provided above the gear 103*b* and meshes with the gear 103*b*.

The gear 104 is fixed to an inner position from an end of the X-axis movable shaft 62. The gears 106 are fixed to both ends of the X-axis movable shaft 62. The gears 106 mesh with the X-axis sliding racks 55. Activating the X-axis motor 91 or rotating the roller 69 by hand rotates the X-axis movable shaft 62, and whereby the crane main body 54 can be moved in the X-axis direction.

A gear 114 which is fixed to a shaft of the Y-axis motor 92 meshes with a gear 115*a*, as shown in FIGS. 4, and 6. Teeth of the gear 115*a* are formed perpendicular on a circular surface and arranged on a circumference. A gear 115*b* having a smaller pitch circle diameter than the gear 115*a* is formed at an upper side of a center of the gear 115*a*. Teeth of the gear 115*b* are formed lateral on a lateral circular disc. A gear 116 is fixed above a gear 113. A circular cylinder is formed to a bottom of the gear 116, and a bottom face of the circular cylinder contacts with a top face of the gear 113. The gears 113, 115, 116 are fixed to a shaft 117.

The roller 69 for rotating gears relevant to the Y-axis by hand is provided to a rear end portion on the bottom face of the crane main body 54. An end of a shaft 111 is fixed to a center of a back face of the roller 69, and a gear 112 is fixed to the other end of the shaft 111. The gear 112 engages with the gear 113. An input gear mechanism is made up with the gear 112 and gear 113.

The gear 115*b* meshes with a gear 118*a*. A gear 118*b* having a smaller pitch circle diameter than the gear 118*a* is formed at an upper side of a center of the gear 118*a*. The gear 113 meshes with the gear 118*b*. Gears 119 are fixed to a shaft 120 above the gears 118. A gear 119*b* having a smaller pitch circle diameter than a gear 119*a* is formed at an upper side of a center of the gear 119*a*. The gear 116 meshes with the gear 119*a*. The gear 119*b* meshes with a gear 121. Teeth of the gear 121 are formed perpendicular on a circular surface and arranged on a circumference. The gear 121 is fixed to a position approximately center of the Y-axis movable shaft 63.

The gears 123 are fixed to both ends of the Y-axis movable shaft 63. The gears 123 mesh with the Y-axis sliding racks 57. Activating the Y-axis motor 92 or rotating the roller 69 by hand rotates the Y-axis movable shaft 63, and whereby the crane main body 54 can be moved in the Y-axis direction.

A gear 133 which is fixed to a shaft of the Z-axis motor 93 meshes with a gear 132*a*. A gear 132*b* having a smaller pitch circle diameter than the gear 132*a* is formed at a front side of a center of the gear 132*a*. A gear 134 is fixed in front of the gear 132*b*, and a gear 135 is fixed in front of the gear 134. A circular cylinder is formed at a back face of the gear 135, and a back face of the circular cylinder contacts with a front face of the gear 134. The gears 132*a*, 132*b*, 134, 135 are fixed to a shaft 136.

The roller 70 for rotating gears relevant to the Z-axis by hand is provided to a position approximately center of the side surface of the crane main body 54 and above the slide frame 53. A half of the roller 70 is arranged inside the crane main body 54, and a remaining half is exposed to the outside. The roller 70 has a rotating part at its front and a gear 131 is fixed to its back face, as shown in FIGS. 5, 7. The gear 131 meshes with the gear 132*a*. An input gear mechanism is made up with the gears 131 and 132*a*.

The gear 132*b* meshes with a gear 137*a*, as shown in FIGS. 4, and 6. A gear 137*b* having a smaller pitch circle diameter than the gear 137*a* is formed at a front side of a center of the gear 137*a*. The gear 134 meshes with the gear 137*b*. Gears 138*a*, 138*b* are fixed to a shaft 139 in front of the gears 137*b*. The gear 138*b* having a smaller pitch circle diameter than the gear 138*a* is formed at a front side of a center of the gear 138*a*. The gear 138*a* meshes with a gear 140. A gear 141 is provided behind the gear 140, and the gears 140, 141 are fixed to a shaft 142.

A member 143 for winding the second chain 67 behind the gear 141 is fixed to the shaft 142. A member 144 for winding the first chain 66 behind the member 143 is fixed to the shaft 142. A fixing portion 145, which is a thin circular cylindrical shape and an end of the second chain 67 is fixed to, is formed on the member 143. A fixing portion 146, which is a thin circular cylindrical shape and an end of the first chain 66 is fixed to, is formed on the member 144.

Activating the Z-axis motor 93 or rotating the roller 70 by hand rotates the members 143, 144, and whereby the second chain 67 passing through the hole 80 and the first chain 66 passing through the hole 79 can be moved in the Z-axis direction, where the both holes 79, 80 are formed on the bottom surface of the crane main body 54.

A maintenance method for the crane main body 54 will be described. A long period of use of the crane game machine 1 may sometimes cause problems such as drying up of grease applied to the gears inside the crane main body 54 or jamming of gears/shafts due to accumulated dust. When such jamming occurs on the crane main body 54 or catcher 65, maintenance can be performed with rotating the rollers 68, 69, 70 by hand.

When rotating the rollers 68, 69, 70 by hand, remove the back plate 43 and put a hand into the crane game machine 1 from a rear side for accessing the rollers 68, 69, 70, as shown in FIGS. 1, and 2. The roller 68 is provided to the lower right portion on the front face of the crane main body 54, and the roller 69 is provided to the rear end portion on the bottom face of the crane main body 54, as shown in FIG. 3. The rollers 68, 69 are rotated by hand with ease since the rollers 68, 69 are provided to the lower part of the crane main body 54. The roller 70 is rotated by hand with ease since the half of the roller 70 is exposed from the side surface of the X-axis positive direction, although the roller 70 is provided to the position in the vicinity of the center of the side surface of the crane main body 54 and above the slide frame 53.

A Y-axis switch 60 is provided to the front side of an upper part of the crane main body 54, and a part of the Y-axis switch 60 projects from the side surface of the crane main body 54, as shown in FIG. 2. While the crane main body 54 is moving in the Y-axis direction and coming close to a front frame of the movable part support frame 52, the Y-axis switch 60 is pressed by contact with the slide frame 53, and then the crane main body 54 moving in the Y-axis direction is stopped.

When the crane main body 54 moves toward a rear frame of the Y-axis positive side, a clutch (not shown) of a Y-axis rotation transmission mechanism, which is built in the crane main body 54, is activated to stop the Y-axis directional movement of the crane main body 54. Alternatively, the Y-axis switch may be disposed to the rear side of the upper part of the crane main body 54.

The crane main body 54 is provided by being inserted within a frame of the slide frame 53 in such a manner that the gears 123 of the Y-axis movable shaft 63 and lower projections of the crane main body 54 nip the slide frame 53 from upper and lower sides. In addition, the gears 123 of the Y-axis movable shaft 63 mesh with the Y-axis sliding racks 57. The slide frame 53 is provided in such a manner that the gears 106 and a lower frame of the X-axis movable shaft 62 nip the movable part support frame 52 from upper and lower sides. In addition, the gears 106 of the X-axis movable shaft 62 mesh with the X-axis sliding racks 55. Furthermore, the slide frame 53, to which the crane main body 54 is provided, is covered by a movable part cover (not shown).

A plane surface may be formed, instead of a gear receiver, at apart of the Y-axis sliding racks 57 so that the crane main body 54 can be returned to a normal position which is parallel to the X-axis and Y-axis.

Figure 9:
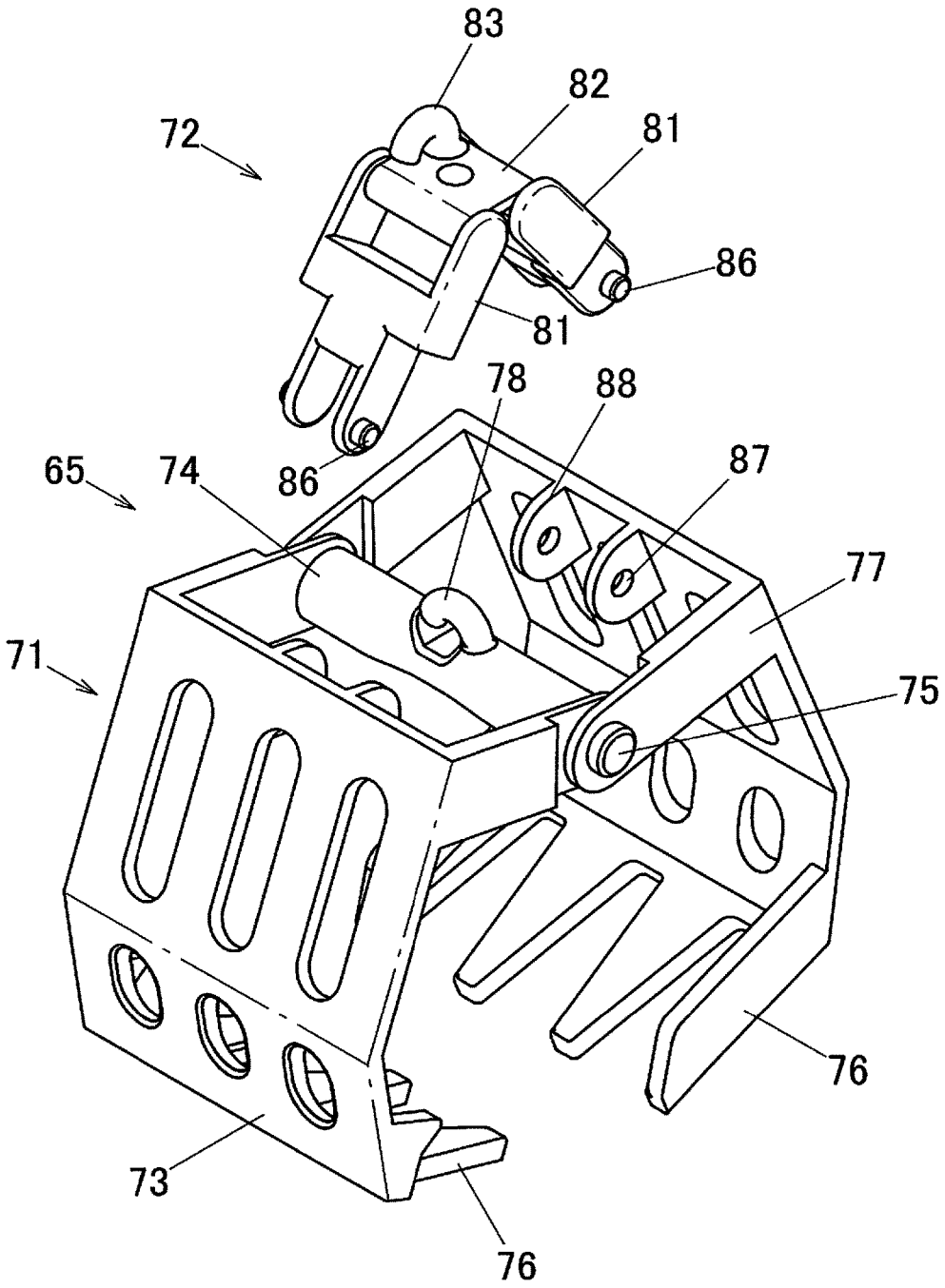
FIG. 9 is an exploded view of the catcher according to the embodiment of the present invention.

The catcher 65 is designed for grabbing the prize 6, and made up of the catcher main body 71 and the upper support part 72, as shown in FIGS. 8, and 9. The catcher main body 71 is made up of two grabbing members 73, a grab shaft 74, and a pin 75. The grabbing members 73 grab the prize 6 from both sides and define a prize-holding space for holding the prize 6 when interlock with each other, the grab shaft 74 is a shaft of the grabbing members, and the pin 75 assembles the grabbing members 73 and grab shaft 74.

Bottom parts of the grabbing members 73 are formed into a shape of teeth. When the two grabbing members 73 interlock with each other, as shown in FIG. 1, a flat surface is formed as a bottom surface by the teeth parts of the two grabbing members meshing with each other, hence the shape of teeth facilitates the grabbing of the prize 6. Since the bottom parts form the flat surface, the catcher 65 is not opened by the weight of the prize 6 when the catcher 65 moves with holding the prize 6. Moreover, standing wall plates 76 are vertically formed at both sides of the bottom parts, thus, the prize 6 is prevented from dropping out when the catcher 65 moves with holding the prize 6.

An inclined plate is formed in a vicinity of a root of the each teeth shaped bottom part, and a side plate is perpendicularly formed at the other end of the inclined plate, respectively. Flat shaped arms 77 project from opposite sides of a top end portion of the each side plate. In addition, a rotation hole 87, through which a rotational protrusion 86 of the upper support part 72 (described later) is inserted, is formed on a projection 88 provided in a vicinity of an upper center of the catcher main body 71. Distal ends of the arms 77 are made so as to be inclined slightly upwardly when the grabbing members 73 are interlocked with each other.

A pin insertion hole through which the pin 75 is inserted is formed at a distal end of the each arm 77. Inside surfaces of the distal ends of the arms 77 of the one grabbing member 73 are made thin, and outside surfaces of the distal ends of the arms 77 of the other grabbing member 73 are made thin, so that the grabbing members 73 are coupled facing each other. A bore of the pin insertion hole is formed larger in diameter than the external diameter of the pin 75, therefore the pin insertion hole rotates freely around a circumferential edge of the pin 75 when the metal pin 75 is inserted into the pin insertion hole.

The grab shaft 74 is a circular cylindrical shape having a curved portion at a center thereof. A first chain connection part 78 to which the first chain 66 is connected is formed at a position facing the curved portion of the grab shaft 74. In addition, pin receiving parts for receiving the pin 75 are formed at a center of top and bottom ends of the grab shaft 74.

The catcher main body 71 has the two grabbing members 73 which are coupled facing each other with the pin insertion holes of all the arms 77 aligned along the same axis. In addition, a center axis of the grab shaft 74 is positioned so as to align on an axis of the pin insertion holes and the pin 75 is fastened to the pin receiving parts of the grab shaft 74 with passing through the pin insertion holes. When the grabbing members 73 are in an opened state, pulling up the first chain connection part 78 makes the catcher main body 71 closed by the two grabbing members 73 being rotated around the pin 75 and then being interlocked facing each other due to weight of the grabbing members 73.

An opening, which is defined when the grabbing members 73 are interlocked facing each other, is designed so as to be smaller than the size of the prize 6 for preventing the prize 6 from dropping out from the opening when the catcher 65 moves. In addition, the prize-holding space is defined having substantially the same size as the prize 6 for facilitating holding the prize 6.

The upper support part 72 comprises, as shown in FIG. 9, two supporting members 81 connected to projections 88 of the grabbing members 73, and a connecting member 82 for connecting the two supporting members 81. The each supporting member 81 is made by forming top and bottom ends of a strip-like plate into round shapes, forming projections on the same surfaces in a vicinity of the top and bottom ends, bending the strip-like plate at a prescribed position of the surfaces having the projections so as to form into a hook shape, and connecting so formed two hook shaped plates using a connecting plate so that the projections face each other. The projections formed on the top ends of the supporting members 81 are connecting projections to be connected rotatably to the connecting member 82 (described later), and the projections formed on the bottom ends of the supporting member 81 are rotating projections 86 to be inserted rotatably into the rotation holes 87 of the projections 88 formed on an upper inside of the grabbing member 73.

The connecting member 82 is a substantially rectangular parallelepiped shape plate, corners of which in longitudinal direction are rounded, on which connecting holes are formed in a vicinity of both ends of both surfaces of the connecting member 82 in transverse direction so as to be connected to the connecting projections of the supporting members 81, and has a through hole penetrating from a center of a top surface to a center of a bottom surface for the first chain 66 to pass through. Additionally, a second chain connection part 83 to be connected to the second chain 67 is formed in a vicinity of the through hole.

The upper support part 72 and the catcher main body 71 are put together by connecting the connecting projections of the supporting members 81 to the connecting holes of the connecting member 82, and by connecting the rotating projections 86 to the rotation holes 87 of the projections 88 of the grabbing member 73. Furthermore, the first chain 66 is connected to the first chain connection part 78 of the catcher main body 71 with penetrating the through hole of the connecting member 82, and the second chain 67 is connected to the second chain connection part 83 of the upper support part 72.

In order to move down the catcher 65, firstly the first chain 66 is rolled down by rotating the Z-axis motor in positive direction until the whole catcher 65 is suspended by only the second chain 67, whereby the grab shaft 74 of the catcher main body 71 connected to the first chain 66 is lowered down by a weight of the pin 75, the supporting members 81 come closer to each other by being pulled by the connecting member 82 of the upper support part 72, and then the grabbing members 73 connected to the supporting members 81 are pulled at the rotation holes of the arms 77, whereby the grabbing members 73 are opened around the grab shaft 74. Next, the second chain 67 is reeled out like following the first chain 66 after the grabbing members 73 are completely opened, whereby the catcher 65 is moved down.

In order to move up the catcher 65, firstly the first chain 66 only is rolled up by rotating the Z-axis motor in negative direction until the whole catcher 65 is suspended by only the first chain 66 connected to the catcher main body 71, whereby the grabbing members 73 are closed around the grab shaft 74 since the grab shaft 74 is pulled up by the first chain 66. Next, the second chain 67 is rolled up like following the first chain 66 after the grabbing members 73 are completely closed, whereby the catcher 65 is moved up.

The crane main body 54 rolls up the first chain 66 first and then rolls up the second chain 67 for moving up the catcher 65, therefore the first chain 66 is pulled up in a strained state and whereby the catcher 65 being closed. When moving down the catcher 65, since the first chain 66 is rolled down first, the second chain 67 is in the strained state and whereby the catcher 65 is opened.

The roof 5, on which the picture of the character or the like is drawn, is arranged so as to cover a top part of the housing part 3 as shown in FIG. 1. The crane game machine 1 which is popular to young children can be provided by coordinating the whole crane game machine 1 with characters popular to young children and using sounds of the character's voice and song.

Figure 10:
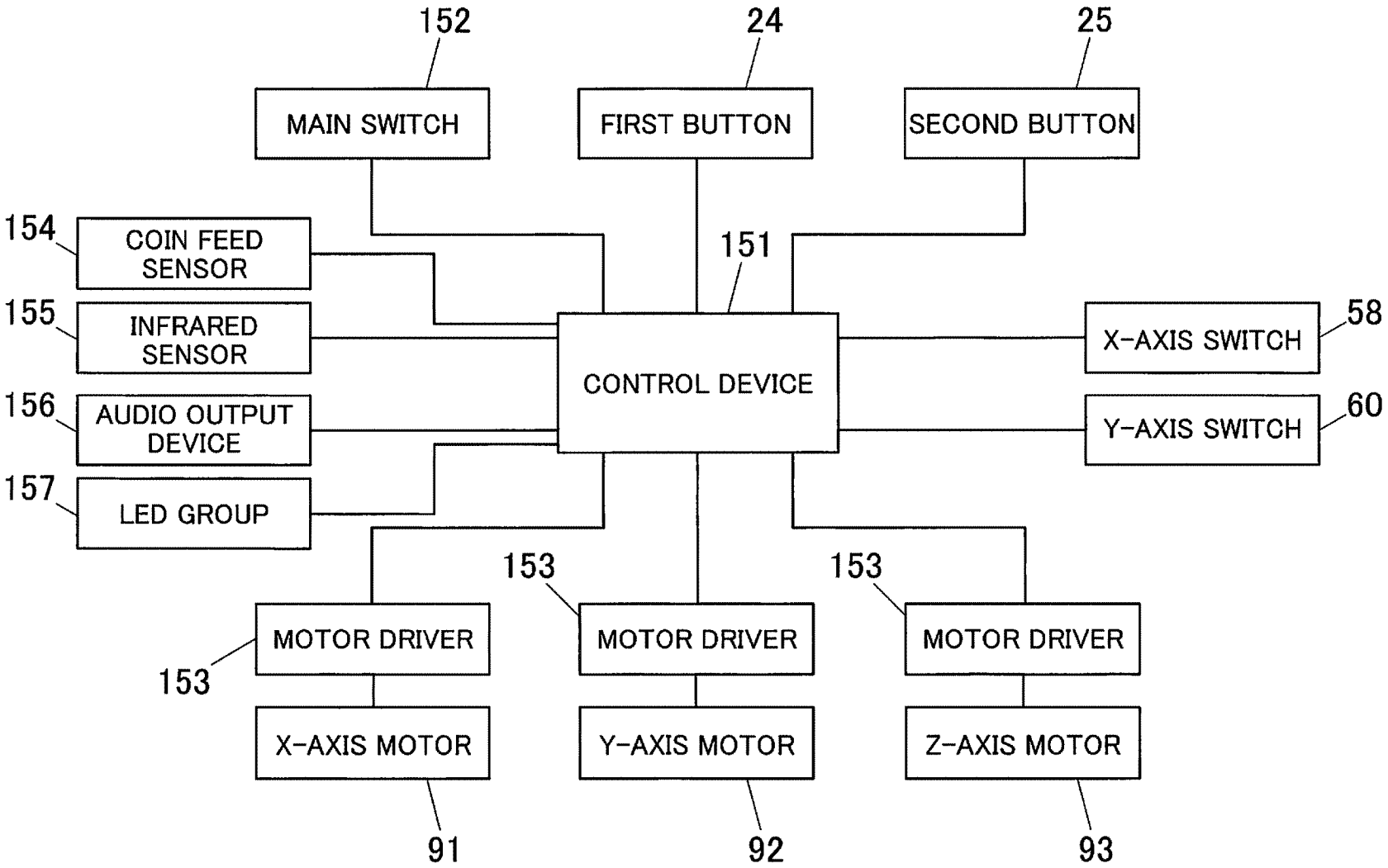
FIG. 10 is a control block diagram of a main substrate according to the embodiment of the present invention.

As shown in FIG. 10, the main substrate has a control device 151, and connected to the control device 151 are a main switch 152, the first button 24, the second button 25, a motor driver 153, a coin feed sensor 154, an infrared sensor 155, a sound output device 156, a LED group 157, the X-axis motor 91, the Y-axis motor 92, the Z-axis motor 93, the X-axis switch 58, and the Y-axis switch 60.

The main switch 152 cuts off power from a battery to the main substrate when the switch 152 is in OFF state, and supplies the power to the main substrate so as to switch the coin feed sensor 154 to a standby state when the switch 152 is in ON state.

The first button 24 outputs a X-axis motor movable signal to the control device 151 while being pushed. Once the first button 24 is released, the control device 151 deactivates the first button 24 and switches the second button 25 to a standby state. The second button 25 outputs a Y-axis motor movable signal to the control device 151 while being pushed. Once the second but ton 25 is released, the control device 151 deactivates the Y-axis motor and outputs a Z-axis motor movable signal to the Z-axis motor 93.

The coin feed sensor 154 outputs a game start signal to the control device 151 when coin insertion from the coin slot 23 is detected. When the game start signal is received, the control device 151 outputs a prescribed sound output signal to the sound output device 156 and outputs a prescribed emission signal to the LED group 157.

The infrared sensor 155 monitors the prize drop port 37 for the prize 6 passing through. When the prize 6 is detected, the acquisition success signal is outputted to the control device 151. When the acquisition success signal is received, the control device 151 outputs a prescribed sound output signal to be played in an acquisition success to the sound output device 156, and outputs a prescribed emission signal to the LED group 157.

The sound output device 156 outputs a sound which suits the prescribed sound output signal when the prescribed sound signal from the control device 151 is received. In addition, the LED group 157 similarly emits light in an emission pattern which suits the prescribed emission signal when the prescribed emission signal from the control device 151 is received.

When a drive control signal from the control device 151 is received, the motor driver 153 transmits corresponding electrical power to the X-axis motor 91, the Y-axis motor 92 and the Z-axis motor 93 for controlling driving of the motors. In accordance with the controls of the motor driver 153, the X-axis motor 91 moves the crane main body 54 in the X-axis direction, the Y-axis motor 92 moves the crane main body 54 in the Y-axis direction, and the Z-axis motor 93 also moves the crane main body 54 in the Z-axis direction.

The X-axis switch 58 outputs a X-axis motor stop signal to the control device 151 by being pushed by the crane main body 54 when the crane main body 54 returns to the home position. The Y-axis switch 60 outputs a Y-axis motor stop signal to the control device 151 by being pushed by the crane main body 54 when the crane main body 54 returns to the home position.

In accordance with the crane game machine 1 of the present invention, stoppage of the operation of the crane main body 54 can be restored with ease by rotating the rollers 68, 69, 70 by hand so that the rotation transmission mechanisms inside the crane main body 54 are rotated manually.

Note that the invention is not limited to the embodiment that has been described heretofore and hence can be freely modified or improved without departing from the spirit and scope of the invention.

What is claimed is:

1. A home-use crane game machine comprising: a plurality of motors each having a drive shaft with a gear fitted to the drive shaft; a plurality of rotation transmission mechanisms each of which has a plurality of gears and is individually rotated by each of the plurality of motors respectively; a catcher for grabbing a prize which is moved up and down in a Z-axis direction by a chain wound by a chain winding member connected to a first one of the plurality of rotation transmission mechanisms; a crane main body having the plurality of motors and the plurality of rotation transmission mechanisms internally; a slide frame for moving the crane main body in an X-axis direction; an X-axis movable shaft connected to a second one of the plurality of rotation transmission mechanisms and moving the crane main body in the X-axis direction; and two X-axis sliding racks which have gear receivers individually engaged with end gears provided at both end portions of the X-axis movable shaft, the two X-axis sliding racks are each formed to project inwards on front and back side surfaces of a support frame, the two X-axis sliding racks being engaged along both sides of the slide frame so as to slide the slide frame provided with the crane main body in the X-axis direction, wherein: one of the two X-axis sliding racks has a part thereof having a plane surface without the gear receiver, wherein the plane surface is arranged between two sections of the gear receiver aligned in the X-axis direction on the one of the two X-axis sliding racks, and one of the end gears is positioned on the plane surface and the other of the end gears mesh with the gear receiver of the other one of the two X-axis sliding racks so that the slide frame returns to a normal position.

* * * * *